US007052107B2

(12) United States Patent
Yamada et al.

(10) Patent No.: US 7,052,107 B2
(45) Date of Patent: May 30, 2006

(54) INK JET PRINTING APPARATUS, PRINT HEAD PERFORMANCE RECOVERING DEVICE, AND PRINT HEAD PERFORMANCE RECOVERING METHOD

(75) Inventors: Hiroshi Yamada, Kanagawa (JP); Osamu Iwasaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 53 days.

(21) Appl. No.: 10/849,954

(22) Filed: May 20, 2004

(65) Prior Publication Data

US 2004/0233247 A1 Nov. 25, 2004

(30) Foreign Application Priority Data

May 23, 2003 (JP) ..... 2003-146964

(51) Int. Cl.
*B41J 2/165* (2006.01)

(52) U.S. Cl. ..... 347/23; 347/30; 347/29; 347/33; 347/35

(58) Field of Classification Search ..... 347/22–35; 358/296

See application file for complete search history.

(56) References Cited

U.S. PATENT DOCUMENTS 5,493,319 A * 2/1996 Hirabayashi et al. ..... 347/29
6,299,278 B1 * 10/2001 Hanabusa et al. ..... 347/33

FOREIGN PATENT DOCUMENTS

JP 07-237301 9/1995

* cited by examiner

*Primary Examiner*—Shih-Wen Hsieh
(74) *Attorney, Agent, or Firm*—Morgan & Finnegan, LLP

(57) ABSTRACT

A preliminary ejection operation, which ejects ink not contributing to an image forming from ejection openings of the print head, is performed following the wiping of a face of the print head to remove residual ink from the print head face while minimizing the amount of ink ejected by the preliminary ejection. This avoids a degradation of an ink ejection performance of the print head and thereby ensures a high quality of printed image. For this purpose, in performing the preliminary ejection operation following the print head wiping operation, one preferred example changes the number of ink droplets to be ejected by the preliminary ejection operation according to a cumulative count of wiping operations.

12 Claims, 6 Drawing Sheets

INK JET PRINTING APPARATUS, PRINT HEAD PERFORMANCE RECOVERING DEVICE, AND PRINT HEAD PERFORMANCE RECOVERING METHOD

This application claims priority from Japanese Patent Application No. 2003-146964 filed May 23, 2003, which is incorporated hereinto by reference.

BACKGROUND OF THE INVENTION

1. Field of the Invention

The present invention relates to an ink jet printing apparatus that forms an image on a printing medium by using a print head capable of ejecting ink from its ejection openings. The invention also relates to a device and a method to recover a performance of the print head.

2. Description of the Related Art

Ink jet printing apparatus have many advantages, such as a relative ease with which a print head can be reduced in size, an ability to print a high resolution image at high speed, an ability to print on plain paper without having to apply a special treatment to it, a low running cost, low noise realized by a non-impact printing, and an ease with which color images can be printed using multiple color inks. A bubble jet (trademark) print head that utilizes thermal energy in ejecting ink, in particular, can easily be reduced in size. By taking advantage of features of IC and microfabrication techniques, this type of print head can easily be manufactured in an elongated form, a two-dimensional form or a full multi-type form, and also in a high density construction.

Among such bubble jet (trademark) print heads are an edge shooter type print head that ejects ink parallel to a heater board incorporating electrothermal transducers and a side shooter type print head that ejects ink in a direction perpendicular to the heater board. In the side shooter type print head, an electrical connection portion between a print chip and an electric wiring member is provided on a face of the print head (a surface in which ink ejection openings are formed). The print chip is a nozzle plate formed by the above-mentioned fabrication process using the IC or microfabrication technologies. The electric wiring member may be, for example, a TAB to send a signal from an ink jet printing apparatus to the print chip. The electrical connection portion needs to be sealed with a sealant of resin or the like that is impervious to ink and electrically non-conductive.

Among the ink jet printing apparatuses, there is a serial scan type printing apparatus which forms an image by reciprocally moving the print head over print paper (printing medium) with a small gap therebetween and at the same time ejecting ink droplets from ejection openings of the print head onto the printing medium. As the image forming is performed by reciprocally moving the print head, foreign matters such as viscous ink, dirt and paper dust may adhere to the face of the print head, interfering with a stable ink ejection operation. To prevent a possible printing failure due to the adhesion of foreign substances and to improve a printing performance, a cleaning means is used to remove the adhering foreign substances from the print head. This cleaning means wipes the face of the print head with, for example, a wiper blade of an elastic rubber member such as urethane rubber to remove the foreign substances.

Such a conventional technology is disclosed, for example, in Japanese Patent Application Laid-open No. 7-237301 (1995).

Generally, in a print head using a pigment ink, it is known that the wiping operation for removing the remaining pigment ink off the face of the print head can, after having been repeated a large number of times, degrade a water repellency of the print head face. Once the water repellency of the print head face deteriorates, the wiping operation may not be able to wipe the face clean, leaving the pigment ink on the face. If the print head in this condition ejects ink from its ejection openings, an ink droplet being ejected is pulled by the residual ink near the ejection opening, with the result that the ink droplet may not be projected in the normal direction and land at a deviated position on a printing medium. This in turn may cause density variations of a printed image in the form of light or dark lines, degrading a print quality.

SUMMARY OF THE INVENTION

An object of this invention is to perform, after the wiping of a face of the print head, a preliminary ejection operation which ejects ink not contributing to an image forming from ejection openings of the print head to remove residual ink from the print head face while minimizing the amount of ink ejected by the preliminary ejection, in order to avoid a degradation of an ink ejection performance of the print head and thereby ensure a high quality of printed image.

This invention is based on the following findings.

When ink with relatively small contact angles, for example a resin-dispersion type or self-dispersion type pigment ink to which polymer is added, is used, the ink can easily remain on the print head face even immediately following the wiping operation if a repellency of the face is degraded. In a condition ink remain on the print head face, if ink droplets are ejected from each ejection opening of the print head, the ink droplets can not fly in an intended direction, though the ink remaining on the print head face near the ejection openings is drawn into the ejection openings, with no ink left near the ejection openings. As a result, subsequently ejected ink droplets can fly in an intended direction without being pulled by the residual ink that would otherwise exist near the ejection openings, and thus can land on the printing medium at correct, intended positions.

That is, immediately after the wiping operation, the ejected ink droplets are deflected because of the residual ink on the face near the ejection openings. After some volume of ink has been ejected, the deflection of ink flying direction no longer occurs.

In the first aspect of the present invention, there is provided an ink jet printing apparatus to form an image by using a print head capable of ejecting ink from its ejection openings, the printing apparatus comprising:

wiping means for wiping an ejection opening formed face of the print head in which the ejection openings are formed;

preliminary ejection means for ejecting ink not contributing to an image forming from the ejection openings of the print head; and modifying means for changing, according to event history information of the print head, the number of ink droplets to be ejected by the preliminary ejection means following a wiping operation of the wiping means.

In the second aspect of the present invention, there is provided a print head recovery device to perform a recovery operation to maintain an ink ejection performance of a print head in good condition, the print head being capable of ejecting ink from its ejection openings, the print head recovery device comprising:

wiping means for wiping an ejection opening formed face of the print head in which the ejection openings are formed;

preliminary ejection means for ejecting ink not contributing to an image forming from the ejection openings of the print head; and modifying means for changing, according to event history information of the print head, the number of ink droplets to be ejected by the preliminary ejection means following a wiping operation of the wiping means.

In the third aspect of the present invention, there is provided a print head recovery method for performing a recovery operation to maintain an ink ejection performance of a print head in good condition, the print head being capable of ejecting ink from its ejection openings, the print head recovery method comprising the steps of:

using wiping means for wiping an ejection opening formed face of the print head in which the ejection openings are formed and preliminary ejection means for ejecting ink not contributing to an image forming from the ejection openings of the print head; and changing, according to event history information of the print head, the number of ink droplets to be ejected by the preliminary ejection means following a wiping operation of the wiping means.

With this invention, in performing the preliminary ejection operation following the print head wiping to eject ink not contributing to an image forming from the ejection openings of the print head, the number of ink droplets to be ejected by the preliminary ejection operation is changed according to event history information of the print head. This can draw the residual ink on the face of the print head into the ejection openings while minimizing the number of ink droplets ejected by the preliminary ejection. As a result, it is possible to avoid a degradation of an ink ejection performance of the print head and thereby ensure a high quality of printed image.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, embodiments of the present invention will be described by referring to the accompanying drawings.

First Embodiment

Figure 1:
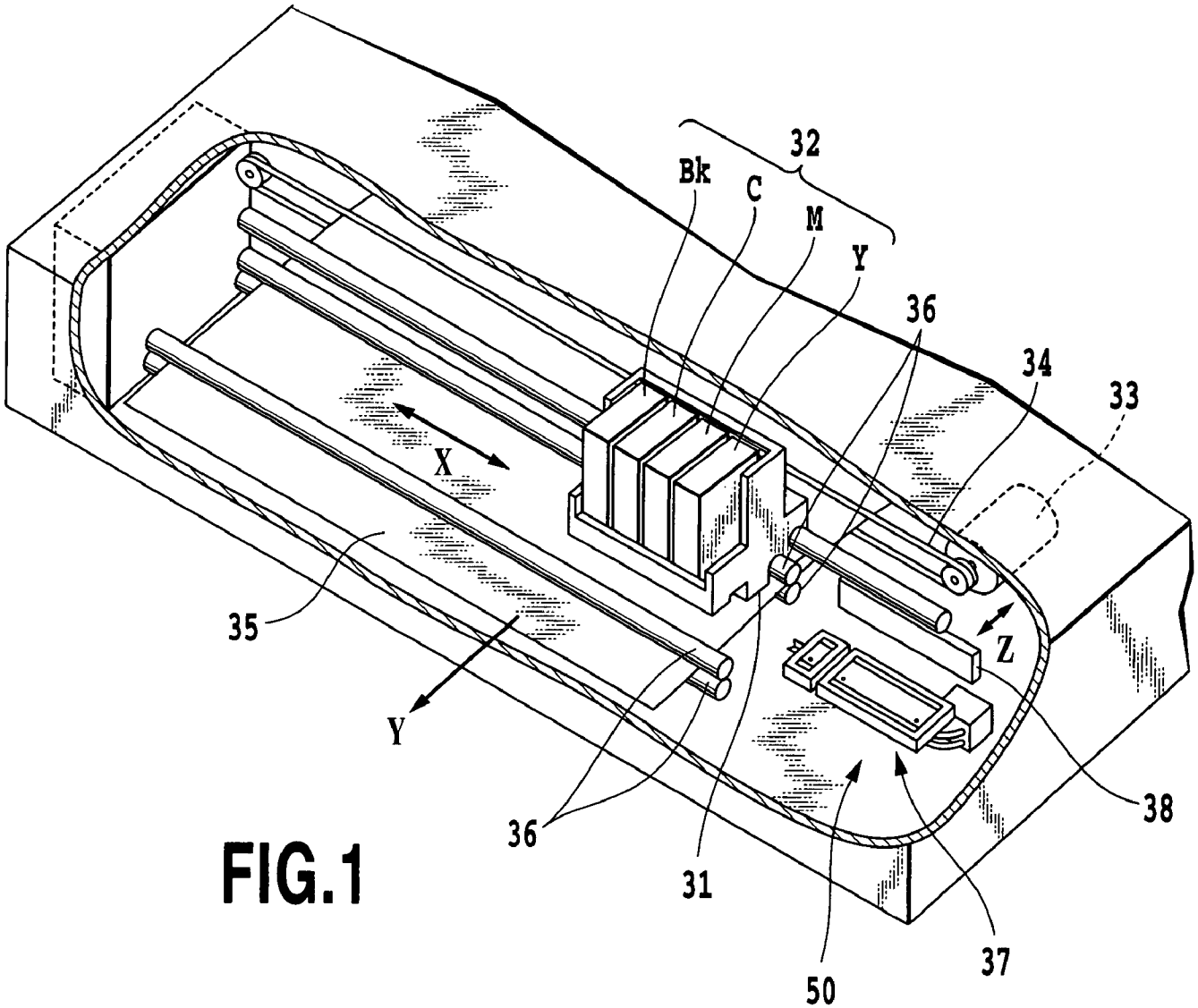
FIG. 1 is a perspective view showing essential portions of an ink jet printing apparatus to which the present invention is applicable.

FIG. 1 is a perspective view showing essential portions of an example construction of a serial scan type ink jet printing apparatus to which this invention can be applied.

Figure 2:
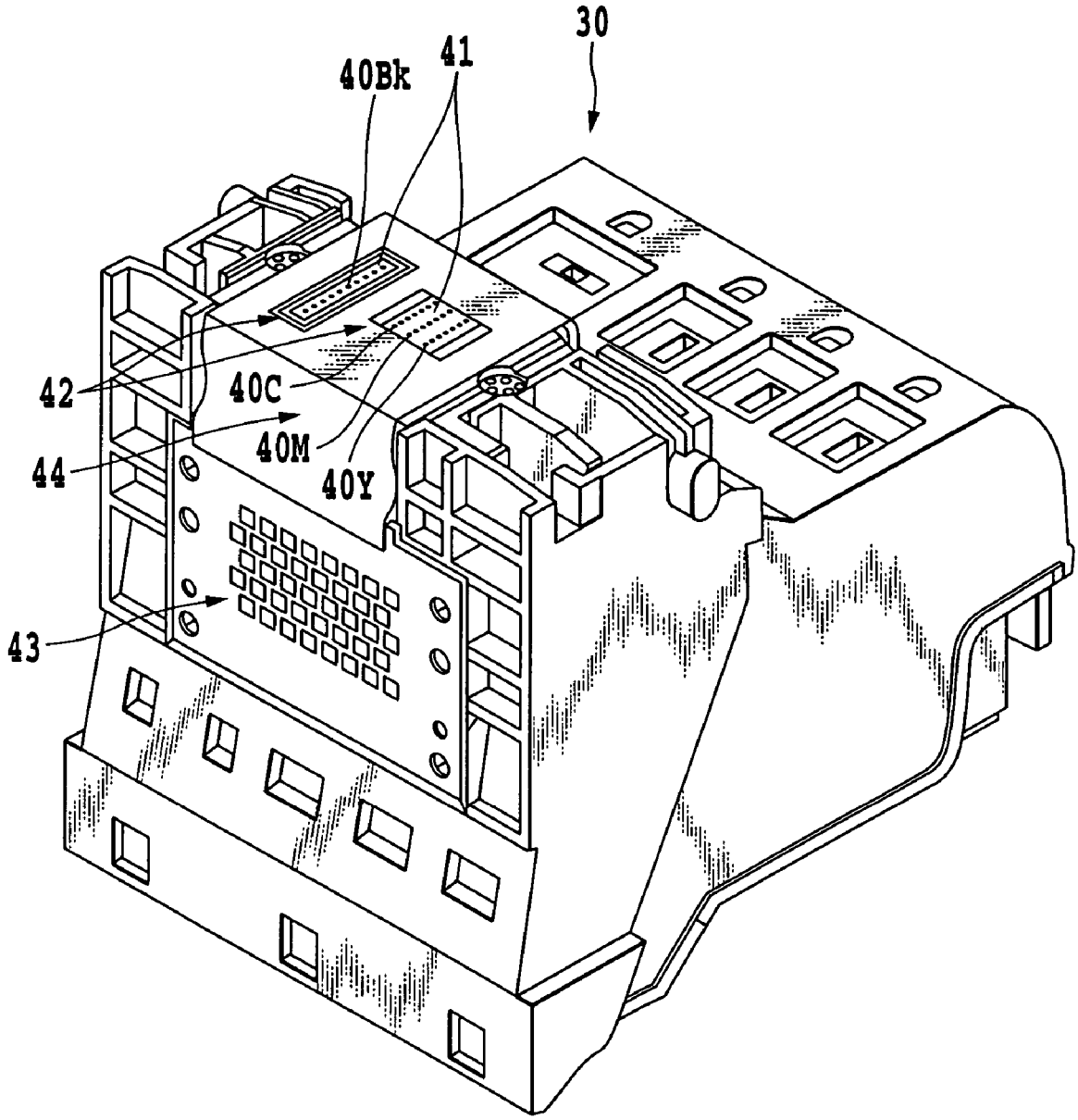
FIG. 2 is an enlarged perspective view of a print head used in the ink jet printing apparatus of FIG. 1.

In FIG. 1, denoted 32 is an ink tank mounted on a carriage 31 along with an ink jet print head 30 of FIG. 2. In this example, four ink tanks containing black (Bk), cyan (C), magenta (M) and yellow (Y) color inks are used as the ink tank 32. The print head 30 can eject the four color inks supplied from these ink tanks 32 from columns (nozzle lines) of ejection openings 40Bk, 40C, 40M, 40Y (see FIG. 2). The carriage 31 is connected to a part of a drive belt 34 driven by a carriage motor 33 and is reciprocally moved in a main scan direction of arrow X by a drive force of the carriage motor 33. The print head 30 has print chips 41 (see FIG. 2).

FIG. 2 is an enlarged perspective view of the print head 30 as seen from the side of the print chips 41. The print chips 41 comprise electrothermal transducers (heaters) formed over a substrate by a semiconductor manufacturing process, such as etching, vapor deposition and sputtering, and ink paths and ejection openings (nozzles) 40Bk, 40C, 40M, 40Y formed over these heaters. A print signal from a host device 200 (see FIG. 3) is transmitted to the heaters of the print chips 41 via an electric contact board 43 and an electric wiring member 44. A joint portion between the print chips 41 and the electric wiring member 44 is sealed with a sealant 42 of electrically nonconductive resin for protection from ink.

The signal applied to each of the heaters arranged in each of the nozzles is transformed into thermal energy which causes ink in the nozzle to film-boil to generate a bubble, which expands and contracts to eject ink from the ejection opening. An ejected ink droplet lands on a printing medium to form an image.

In FIG. 1, a printing medium 35 is fed by a feeding mechanism including rollers 36 in a sub scan direction indicated by an arrow Y, which is perpendicular to a direction in which the carriage 31 moves. The feeding mechanism is driven by a P.F motor 104 (see FIG. 3).

The printing apparatus of this example prints an image over an entire print area of the printing medium 35 by feeding the printing medium 35 a predetermined distance or pitch each time one line of the image is printed on the printing medium 35. That is, an operation of printing an image by moving the print head 30 along with the carriage 31 in the main scan direction and an operation of feeding the printing medium 35 in the sub scan direction are alternated until the entire printing medium 35 is printed with the image.

A cap 37 is provided at a predetermined position outside the print area but within a range of reciprocal movement of the print head 30 in the main scan direction (hereinafter referred to as a "home position"). When the print head 30 is moved to the home position during the non-printing operation, the cap 37 encloses the face of the print head 30 to prevent ink evaporation from the ejection openings.

A recovery unit 50 provided at the home position performs a recovery operation to keep the ink ejection performance of the print head 30 in good condition. The recovery operation may include a discharge operation to forcibly discharge ink not contributing to image forming from the ejection openings of the print head 30, a preliminary ejection to eject ink not contributing to image forming from the ejection openings of the print head 30, and a wiping operation to wipe clean the face of the print head 30 with a wiper blade 38.

The discharge operation may include a suction-based recovery operation that introduces a negative pressure into the cap 37 capping the print head 30 to suck out ink from the ejection openings of the print head 30 into the cap 37 and a pressure-based recovery operation that pressurizes ink in the print head 30 to discharge ink from the ejection openings of the print head 30 into the cap 37. These suction- and pressure-based recovery operations remove foreign matters, such as viscous ink, sticking ink, dirt and bubbles, from the ejection openings to recover the normal ink ejection performance of the print head 30. The preliminary ejection shoots ink not contributing to image forming from the print head 30 toward the interior of the cap 37.

The wiper blade 38 may be formed of an elastic member such as urethane rubber. The wiper blade 38 is standing by at a position where it does not interfere with the scanning operation of the print head 30. In the wiping operation, the wiper blade 38 is moved in the forward and backward direction indicated by an arrow Z by a motor (not shown) installed in the ink jet printing apparatus to wipe foreign matters such as ink, dirt and paper dust off the face of the print head 30 (a print head surface in which ejection openings are formed).

Figure 3:
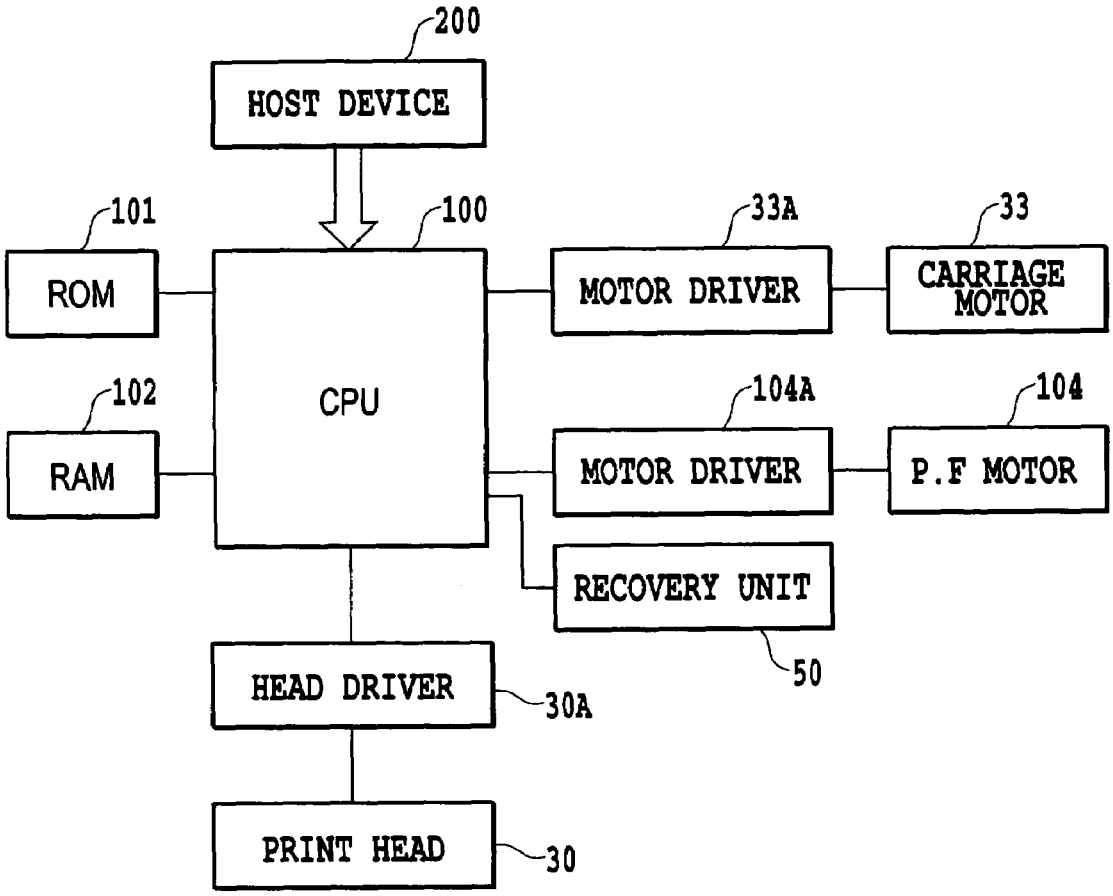
FIG. 3 is an outline configuration of a control system in the ink jet printing apparatus of FIG. 1.

FIG. 3 is an outline block configuration of a control system in the printing apparatus to which this invention can be applied.

In FIG. 3, a CPU 100 controls the operation of the printing apparatus and executes data processing. A ROM 101 stores programs for these processing and a RAM 102 is used as a work area in executing these processing. Ink ejection from the print head 30 is controlled by the CPU 100 supplying heater drive data (image data) and a drive control signal (heat pulse signal) to a head driver 30A. The CPU 100 controls the carriage motor 33 via a motor driver 33A to drive the carriage 31 in the main scan direction and also controls a P.F motor 104 via a motor driver 104A to feed the printing medium 35 in the sub scan direction.

Further, the CPU 100, as described later, forms a means that collects event history information of the print head 30 and controls the recovery unit 50 according to the event history information. Such a means may be provided on the host device 200 side.

Next, inks used in this example will be explained.

Generally, three color inks, cyan, magenta and yellow, used in a color ink jet printing apparatus capable of color image printing are characterized by a fast penetration into plain paper and a quick drying capability, which together prevent intercolor bleeding in a color image formed on plain paper. Such inks, although they can prevent intercolor bleeding in color image portions because of their quick penetration and fixing in the paper, have a disadvantage that black images formed by these inks, such as characters, have a low print density making them look not crisp enough. To deal with this problem, a pigment ink whose pigment coagulates on a surface of the paper can be used as a black ink for forming black images to enhance the print density and thereby improve the print quality.

In a print head using a pigment ink, a water repellency given on the face of the print head deteriorates after the print head face has been subjected to a large number of wiping operations performed to remove the pigment ink remaining on the face or has been in contact with the pigment ink over a long period of time. When the water repellency of the face of the print head is degraded, it is difficult to remove completely the pigment ink on the face with wiping. Particularly when an ink droplet is ejected from an ejection opening, with a residual ink remaining on the face around the ejection opening, the ink droplet being ejected may be pulled by the residual ink near the ejection opening. This may cause the ejected ink droplet to deviate from an intended flying direction and land on a printing medium at a position shifted from the normal position, resulting in density variations in the form of light lines or dark lines (overlapping of ink dots) in a printed image, degrading a print quality.

Example pigment inks of a resin-dispersion type and a self-dispersion type will be described as follows.

<Example of Self-Dispersion Type Pigment Ink>

10 g of carbon black, which has a BET specific surface of 220 $m^2/g$ (a comparison area determined by the BET (Brunauer, Emmett and Teller) equation) and a DBP (Dibutylphthalate) oil absorption of 110 ml/100 g, is mixed well with 1.2 g of p-aminobenzoic acid in 72 g of water. 1.62 g of nitric acid is added to this mixture which is then stirred at 70° C. A few minutes later, a solution of 1.07 g of sodium nitrite dissolved in 5 g of water is added and the mixture is stirred for another hour. The resultant slurry is passed through a filter (product name: Toyo filter No. 2 of Advantis make) and pigment particles thus obtained are thoroughly washed with water and dried in an oven at 90° C. To the dried pigment particles water is added to produce a pigment water solution with a pigment density of 10 wt %. With the process described above, p-C6H4C00-group is introduced onto the surface of carbon black.

| (Manufacture of Black Ink) | |
|---|---|
| Pigment dispersion 1 | 40 g |
| Glycerin | 7 g |
| Diethylene glycol | 5 g |
| Polyethylene glycol 1000 | 5 g |
| 1,2-hexanediol | 1.5 g |
| Styrene/acrylic acid copolymer (weight ratio of 68/32; acid value of 214; average molecular weight of 4029; neutralized by sodium hydroxide; the value of equation = 70.7) | 1 g |
| Residual water | 40.5 g |

These components are mixed and stirred well and the mixture is adjusted to pH 8 with sodium hydroxide.

After this, the mixture is passed through a membrane filter with a pore size of 1.0 μm to obtain a black ink.

| <Example of Resin-Dispersion Type Pigment Ink> | |
|---|---|
| Carbon black (MFC-88 of Mitsubishi Kasei make) | 30 g |
| Styrene-acrylic acid polymer (acid value of 100; neutralized with 1.0 equivalent of KOH) | 8 g |
| Ionized water | 268 g |

These three components are dispersed for one hour by a sand mill using zirconia beads as pulverizing media. The mixture is centrifugalized (at 5,000 rpm for 30 minutes) and filtered through a membrane filter with a pore diameter of 2.5 μm to produce a pigment dispersion liquid.

| | |
|---|---|
| Pigment dispersion liquid described above | 60 g |
| Glycerin | 5 g |
| Diethylene glycol | 5 g |
| Acetylenol EH (KawaKen Fine Chemical) | 0.15 g |
| Ionized water | 29.85 g |

These components are mixed and passed through a membrane filter with a pore diameter of 1.0 μm to produce a black ink.

Of the pigment inks described above, those resin-dispersion type or self-dispersion type pigment inks to which polymer is added generally have small contact angles so that ink adhering to the print head face which comes from satellite ink particles and mist bouncing from a printing medium is not easily repelled. Such residual ink can remain on the face of the print head even after the face is subjected to the wiping operation if the face has a degraded repellency. If in this condition an ink droplet is ejected from an ejection opening, it may be pulled by the residual ink remaining near the ejection opening and land on a deviated position. However, after a plurality of ink droplets have been ejected from the ejection opening, the residual ink near the ejection opening and the ink in the ejection opening come into contact with each other, with the result that the residual ink around the ejection opening is drawn into the ejection opening by a negative pressure generated by a negative pressure mechanism in an ink tank. The negative pressure mechanism is a mechanism to apply a predetermined level of negative pressure to the ink in the ink tank so as to prevent a leakage of ink from the ejection openings by the negative pressure and form an appropriate ink meniscus in the ejection openings to stabilize the ink ejection operation. This ejection of some ink droplets eliminates the residual ink that was remaining near the ejection opening and the ink droplets ejected thereafter will fly in an intended direction and land at correct positions on the printing medium. In other words, if printing operation is performed immediately after the wiping operation, in a certain printing operation period (e.g., a period of a few scans) the printed image quality may become degraded by the adverse effect of the residual ink around the ejection openings.

To minimize a printed image quality degradation due to deviations of ink droplet landing positions immediately following the wiping operation, this invention performs a preliminary ejection according to event history information of the print head to draw the residual ink on the face of the print head into the ejection openings before starting the printing operation.

Figure 4:
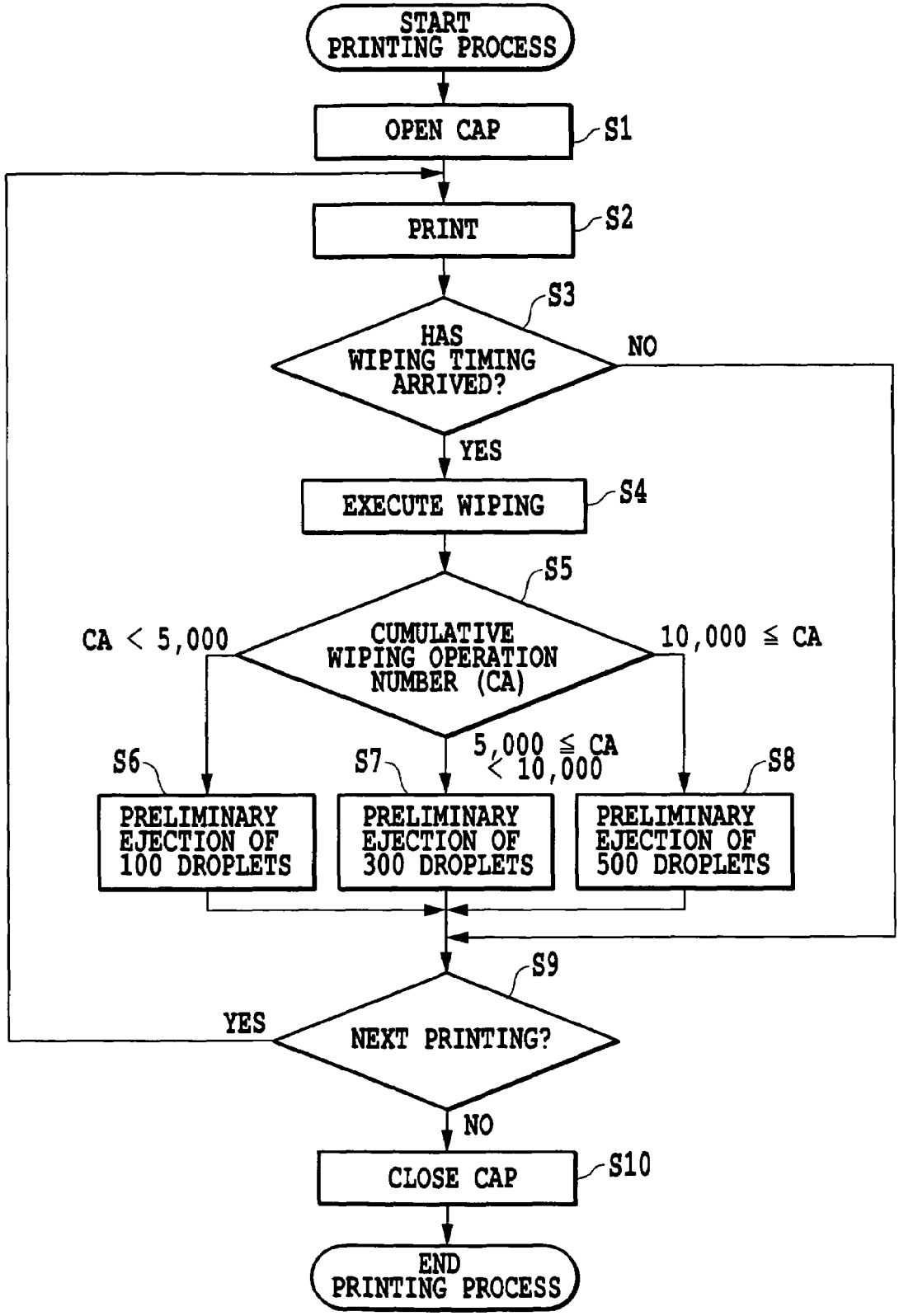
FIG. 4 is a flow chart showing a sequence of printing operation in a first embodiment of this invention.

FIG. 4 is a flow chart showing a sequence of steps performed by an ink jet printing apparatus of this embodiment.

At the start of the printing operation, the cap 37 capping the print head 30 to prevent ink evaporation is opened (step S1). After one page of printing medium 35 is printed (step S2), it is checked whether a wiping operation execution timing is reached (step S3). If it is found that the timing is reached, the wiping operation is performed on the print head 30 (step S4). The wiping operation execution timing is when a suction-based recovery operation is performed to maintain the ink ejection performance of the print head 30 or when a dot count wiping operation is performed to remove a residual ink on the face. The dot count wiping operation is a wiping operation performed depending on a count value of the number of ink droplets ejected.

The wiping operation can be executed during the printing operation of one page of printing medium 35 or every time the printing operation on a predetermined area (e.g., on one or more pages of printing medium 35) is finished. In this embodiment, after one page of printing medium 35 is printed (step S2), it is checked whether a wiping operation execution timing is reached (step S3). This check may be performed at a predetermined time or every time the predetermined print area is printed. At the same time that the wiping operation is performed at these timings, "1" is added to a ROM that stores a cumulative count of wiping operations CA. That is, each time the wiping operation is executed, the total number of wiping operations stored in the ROM is incremented and updated. The ROM for this count may use the ROM 101 (see FIG. 3) or an electrically programmable ROM or EEPROM installed in the printing apparatus body. In the following explanation, this ROM is referred to as an EEPROM.

During the wiping operation viscous ink or other color inks may be pushed into the ejection openings of the print head 30 interfering with normal ink ejections or causing color mixing. Also, in a condition immediately after the wiping operation, the ejected ink droplet may not be flied an intended direction due to the ink adhering to near the ejection opening. To eliminate these problems, a preliminary ejection is performed after the wiping operation. The number of ink ejections during the preliminary ejection performed following the wiping operation is increased according to the cumulative count of wiping operations CA read from the EEPROM.

If the wiping operation has not yet been performed a large number of times, for example, if the cumulative number of wiping operations is less than 5,000 (CA<5,000), the preliminary ejection operation ejects 100 ink droplets from each ejection opening (100 droplets/nozzle) (steps S5 and S6). When the cumulative number of wiping operations is less than 5000, the repellency of the print head 30 is hardly degraded, so almost no ink will remain on the print head face. Thus, the preliminary ejection with as few as 100 droplets/nozzle can remove viscous ink that was pushed into the ejection openings during the wiping operation, thereby preventing color mixture of inks and landing position deviations of ink droplets, and maintaining a high level of print quality.

After the wiping operation has been repeated to some extent, i.e., if the cumulative number of wiping operations falls between 5,000 and 10,000 (5,000≦CA<10,000), the preliminary ejection operation ejects 300 ink droplets from each ejection opening (300 droplets/nozzle) (steps S5 and S7). With the repellency of the face of the print head 30 degraded to some degree by the wiping, some amount of ink will remain on the face, adversely affecting the ink ejection performance. To eliminate landing position deviations caused by the slight degradation of the repellency of the face, the number of ink droplets used in the preliminary ejection operation following the wiping is increased to some degree than that of ink droplets in step S6. This preliminary ejection removes foreign matters such as viscous ink that was pushed into the ejection openings during the wiping operation and draws ink remaining on the face into the ejection openings. Therefore, color mixture of inks and ink droplet landing position deviations can be prevented, and a high level of print quality can be maintained.

If the wiping operation proceeds to be repeated until the cumulative number of wiping operations CA exceeds 10,000 (10,000≦CA), the preliminary ejection operation ejects 500 ink droplets from each ejection opening (500 droplets/nozzle) (steps S5 and S8). With the repellency of the face further degraded so that ink easily remain on the face, the amount of residual ink on the face that needs to be drawn into the ejection openings by the preliminary ejection operation increases. Therefore, the number of ink droplets ejected by the preliminary ejection operation following the wiping is also increased than that of ink droplets in step S7. This can reliably draw the residual ink into the ejection openings to eliminate the ink remaining on the face near the ejection openings, which in turn prevents ink droplet landing position deviations.

As described above, the preliminary ejection operation is performed after each wiping operation and the number of ink droplets used in the preliminary ejection operation is increased according to the cumulative wiping operation number. As a result, in a printing operation that follows (step S9) reducing remain ink on the face thus preventing ink droplet landing position deviations and assuring a high print quality. When the printing operation is ended, the print head 30 is capped with the cap 37 (step S10).

In this embodiment, an example case has been described using particular thresholds of the cumulative number of wiping operations and particular numbers of ink droplets used in the preliminary ejection operations following the wiping operation. It is noted, however, that the thresholds and the numbers of ejected ink droplets can be set as desired according to the performance and characteristic of the ink and print head as long as they can achieve the objectives of this invention. Further, while in this embodiment the preliminary ejection is performed according to the three conditions representing the cumulative number of wiping operations (steps S6, S7, and S8), the number of conditions is not limited to three and may use any arbitrary number that can realize the objectives of this invention.

Second Embodiment

Figure 5:
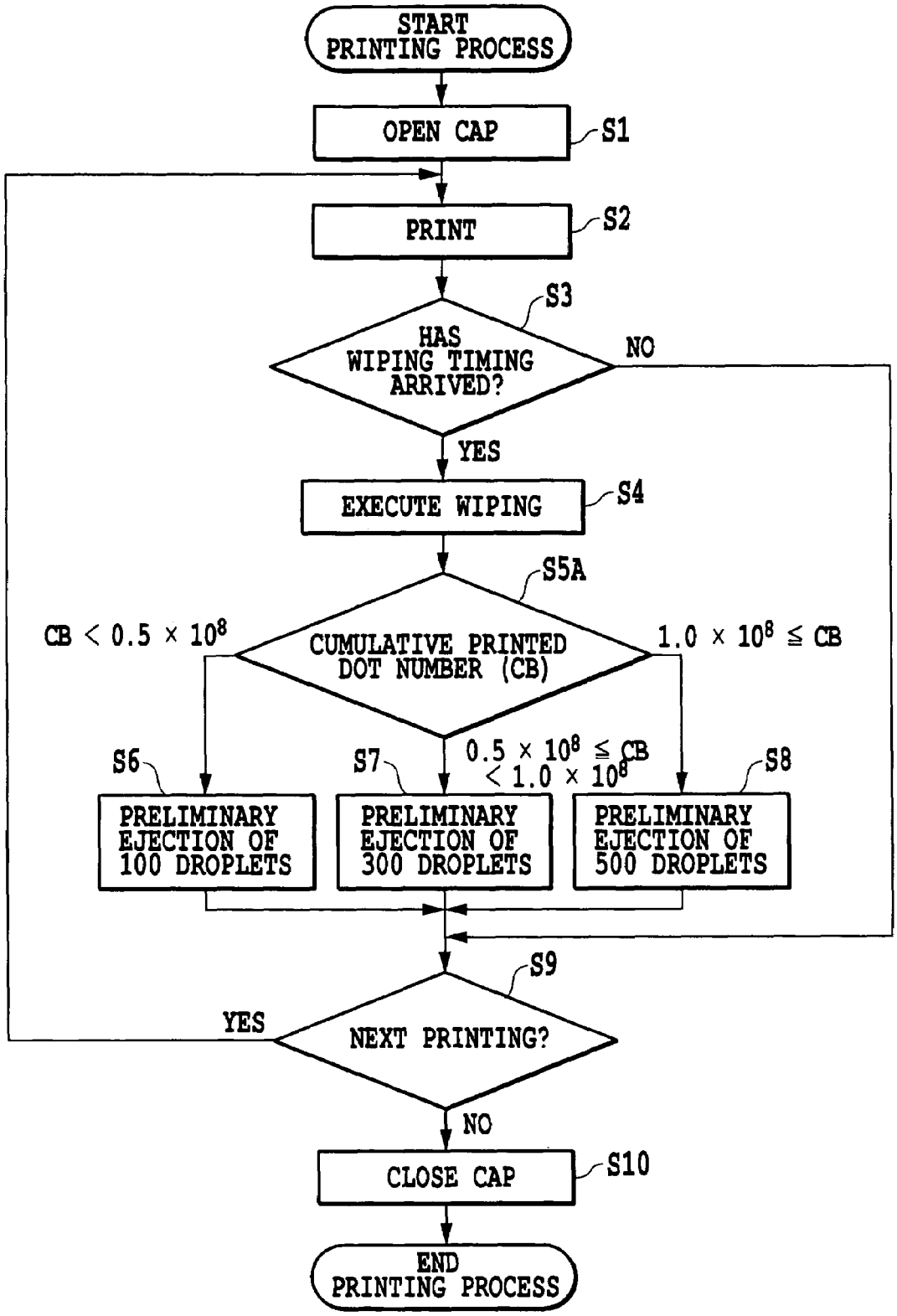
FIG. 5 is a flow chart showing a sequence of printing operation in a second embodiment of this invention.

FIG. 5 is a flow chart showing a sequence of steps in a printing operation performed by the second embodiment of this invention. In the first embodiment, the number of ink droplets ejected by the preliminary ejection is increased according to the cumulative number of wiping operations. In this embodiment the number of ink droplets ejected by the preliminary ejection is increased according to a cumulative number of ink dots CB formed on the printing medium by ink droplets ejected from the print head (hereinafter referred to as a "cumulative number of printed dots"). The cumulative printed dot number CB can be counted based on the image data and also updated in the EEPROM described above.

First, the cap 37 is opened (step S1) and, after one page of printing operation is completed, it is checked whether a wiping operation execution timing is reached (step S2, S3). If it is found that the timing is reached, the wiping operation is performed on the print head 30 (step S4). Then, the number of ink droplets ejected by the preliminary ejection operation following the wiping operation is changed according to the cumulative printed dot number CB stored in the EEPROM in the printing apparatus body. In the printing operation of step S2, the number of ink droplets ejected by the printing operation is added to the cumulative printed dot number CB stored in the EEPROM and the added number is updated in the EEPROM as the cumulative printed dot number CB.

That is, if the cumulative printed dot number CB is less than $0.5\times10^8$ dots ($CB<0.5\times10^8$), the preliminary ejection operation ejects 100 ink droplets from each ejection opening (100 droplets/nozzle) (step S5A, S6). In this state, only a small amount of the pigment ink ejected from the print head 30 remains on the print head face for a short period of time, therefore the repellency of the face is not degraded. Hence, no ink droplet landing position deviations result which would occur if there were ink remaining on the face. Therefore, 100 droplets/nozzle set as the number of ink droplets to be ejected by the preliminary ejection operation following the wiping, is sufficient to remove viscous ink and prevent color mixing.

When the cumulative printed dot number CB is between $0.5\times10^8$ and $1.0\times10^8$ dots ($0.5\times10^8 \leqq CB<1.0\times10^8$), the preliminary ejection operation ejects 300 droplets from each ejection opening (300 droplets/nozzle) (step S5A, S7). In this state, an increased amount of the pigment ink remains on the print head face for a relatively longer period, therefore the degradation of repellency of the face progresses to some extent. This condition is likely to adversely affect the ink ejection performance because ink remains on the face of the print head. If a printing operation is performed in this condition, there is a possibility of density variations occurring in the form of light and dark lines in a printed image. To remove the ink remaining on the face, the number of ink droplets to be ejected by the preliminary ejection operation following the wiping is increased to 300 droplets/nozzle before proceeding to the printing operation on the next page (step S9). During the printing on the next page, no printing failure results because almost no ink is left on the face.

When the cumulative printed dot number CB is $1.0\times10^8$ dots or more ($1.0\times10^8 \leqq CB$), the preliminary ejection operation ejects 500 droplets from each ejection opening (500 droplets/nozzle) (step S5A, S8). In this state, a further increased amount of the pigment ink remains on the print head face for a longer period, therefore the degradation of repellency of the face progresses still further. Increasing the number of ink droplets to be ejected by the preliminary ejection operation following the wiping to 500 droplets/nozzle can thoroughly draw the ink remaining on the face into the ejection openings and thereby prevent ink droplet landing position deviations. As a result, a high quality image can be printed on the next page even after the wiping operation.

By increasing the number of ink droplets ejected by the preliminary ejection operation following the wiping as the number of cumulative printed dot number CB increases, as described above, it is possible to form a high quality printed image regardless of a degree to which the repellency of the print head face is degraded. The threshold value of the cumulative printed dot number described above is given as one example and any other desired value may be taken if it can achieve the objectives of this invention

Third Embodiment

In this embodiment, the number of ink droplets ejected by the preliminary ejection operation following the wiping is changed according to a standby time from a wiping operation to a start of the next printing operation (referred to as an "after-wiping standby time") CT. The after-wiping standby time CT can be determined by measuring a time that elapses following the wiping operation. The after-wiping standby time CT can be updated and recorded in the EEPROM described above.

Figure 6:
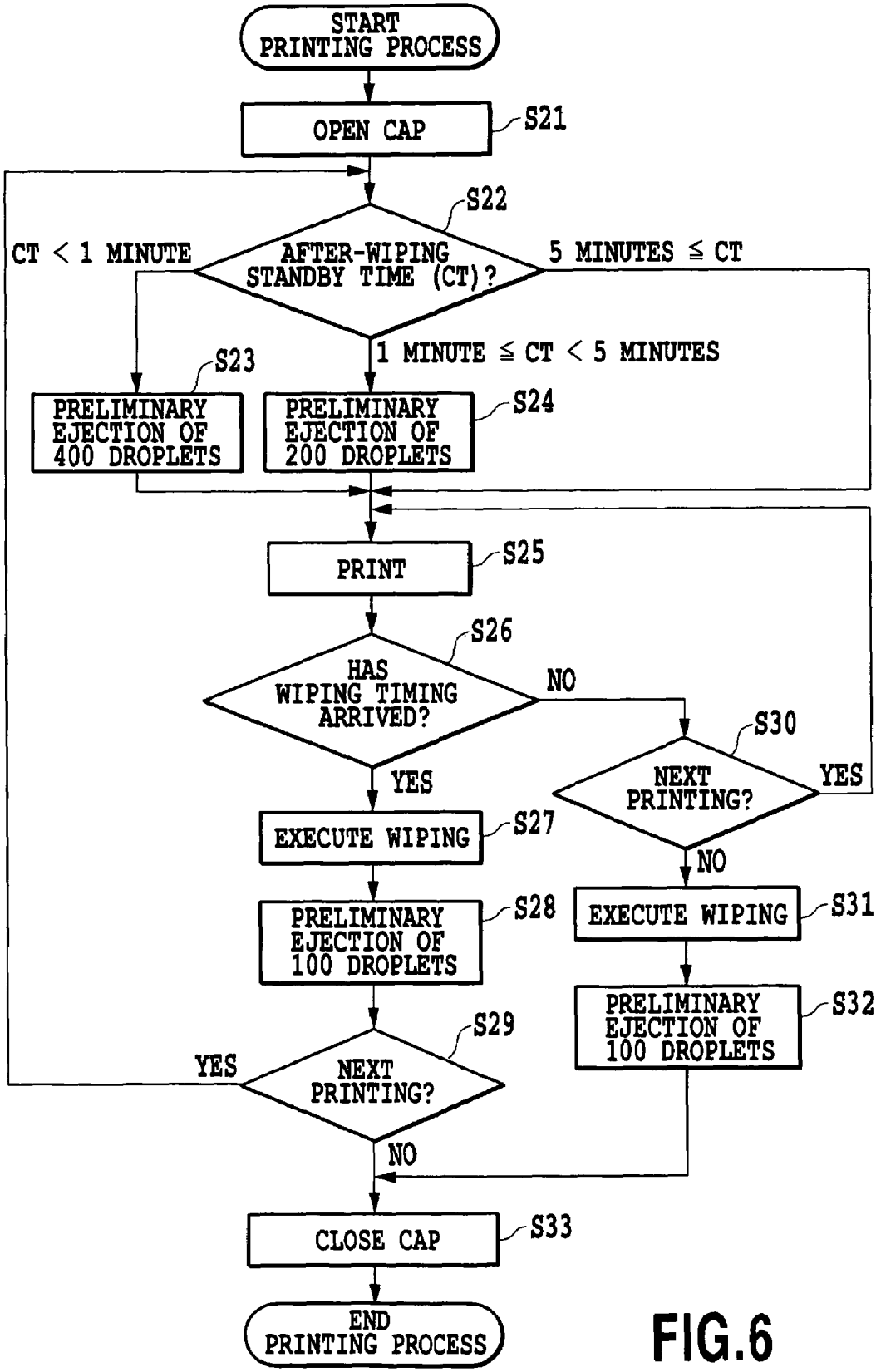
FIG. 6 is a flow chart showing a sequence of printing operation in a third embodiment of this invention.

FIG. 6 is a flow chart showing a sequence of steps in the printing operation of this embodiment.

At the start of the printing operation, the cap 37 capping the print head 30 to prevent ink evaporation is opened (step S21). Then, the after-wiping standby time CT is read out from the EEPROM and the preliminary ejection is performed according to the time CT. Ink remaining on the face of the print head 30 with a degraded repellency is gradually drawn into the ejection openings by a negative pressure generated by the negative pressure mechanism in the ink tank. A longer after-wiping standby time CT means a smaller amount of ink remaining on the face and therefore a smaller number of ink droplets needed to be ejected by the preliminary ejection operation. Conversely, a shorter after-wiping standby time CT means a greater amount of ink remaining on the face and therefore the number of ink droplets to be ejected by the preliminary ejection operation needs to be increased to draw a larger amount of ink into the ejection openings.

In this example, if the after-wiping standby time CT is less than one minute (CT<1 minute), the preliminary ejection operation ejects 400 ink droplets from each ejection opening (400 droplets/nozzle) (step S22, S23). For the after-wiping standby time CT between 1 minute and five minutes (1 minute≦CT<5 minutes), the preliminary ejection operation ejects 200 ink droplets from each ejection opening (200 droplets/nozzle) (step S22, S24). Only after these preliminary ejection operations are performed, the printing operation is executed (step S25). If the after-wiping standby time CT exceeds five minutes (5 minutes≦CT), no preliminary ejection operation is performed before the printing operation is executed (step S22, S25). These arrangements can keep the print head face in a state where there is no ink remaining on the face, even after the wiping operation, allowing for correct ink ejections and therefore a high quality printed image.

If, after one page is printed, a wiping timing comes, the wiping is performed (step S26, S27). The time which elapses from the execution of the wiping is measured as the after-wiping standby time CT. The after-wiping standby time CT is reset each time the preliminary ejection operation is executed at step S23, S24, and its counting is started when the wiping operation is performed (step S27, S31). After the wiping operation is performed, a preliminary ejection operation is done (step S28) to prevent viscous ink from interfering with a normal ink ejection and mixing with different color inks. This preliminary ejection operation ejects 100 ink droplets/nozzle.

Then, if the next page is to be printed, the printing process returns from step S29 to step S22. If the next page printing is not performed, the cap 37 is closed and the printing process is ended (step S29, S33). If the next page printing is to be performed, the printing process returns to step S22, where it performs the preliminary ejection operation according to the after-wiping standby time CT before proceeding to the printing (step S22, S23, S24, S25) or starts printing without executing the preliminary ejection operation (step S22, S25).

If, after the printing operation at step S25 is finished, the wiping timing has not arrived, there is no ink on the face to be wiped off. Therefore, the next page printing can be done immediately to produce a high quality image (step S30, S25). When the next page printing is not performed, the wiping and the preliminary ejection operation are performed (step S31, S32) before closing the cap 37 (step S33) and ending the printing process. The preliminary ejection operation at step S32 ejects 100 ink droplets/nozzle as at step S28.

As described above, the number of ink droplets to be ejected by the preliminary ejection operation following the wiping is changed according to the standby time which elapses after the wiping operation is executed until a subsequent printing action is started. This ensures the printing of a high quality image. It is noted, however, that the number of ink droplets shown above to be ejected by the preliminary ejection operation is only one example and other desired numbers may be used if they can achieve the objectives of this invention.

OTHER EMBODIMENTS

In the preceding embodiments, we focused on a residual ink remaining on the print head face which degrades the ink ejection performance of the print head. According to the cumulative count of wiping operations CA, the cumulative printed dot number CB or the after-wiping standby time CT, all affecting the amount of residual ink on the face, the number of ink droplets to be ejected by the preliminary ejection operation following the wiping is changed. This arrangement reliably removes the residual ink from the face by the preliminary ejection operation to prevent a degradation of the ink ejection performance. In addition to the cumulative count of wiping operations CA, the cumulative printed dot number CB and the after-wiping standby time CT, this invention can use other event history information of the print head, that will influence the ink ejection performance, in changing the number of ink droplets to be ejected by the after-wiping preliminary ejection operation to prevent a possible degradation of the ink ejection performance. Among other event history information of the print head is a cumulative time in which the print head is mounted in the printing apparatus. In that case, as the cumulative print head mounting time increases, the number of ink droplets to be ejected by the after-wiping preliminary ejection operation needs to be increased.

This invention can also be applied widely to a variety of printing apparatus using a print head capable of ejecting inks. For example, the invention is applicable not only to a serial scan type printing apparatus but also to a full line type printing apparatus that uses an elongate print head extending to a full width of a print area of a printing medium. As for the ink ejection system, the print head is not limited to the system using electrothermal transducers (heaters) but may use any desired ejection system, such as one using piezoelectric elements.

As described above, the event history information of the print head may be the cumulative count of wiping operations corresponding to a degree to which the repellency of the print head face is degraded, the cumulative printed dot number representing the number of ink droplets ejected, or the after-wiping standby time related to the amount of residual ink remaining on the face of the print head. According to these event history information, the number of ink droplets to be ejected by the after-wiping preliminary ejection operation can be set optimally. For example, if the print head event history information uses the cumulative count of wiping operations and the cumulative printed dot number, the number of ink droplets to be ejected by the preliminary ejection operation may be increased as these cumulative value increases. Further, if the after-wiping standby time is used as the event history information, the number of ink droplets to be ejected by the preliminary ejection operation may be reduced with an increase in the standby time.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink jet printing apparatus to form an image by using a print head capable of ejecting ink from its ejection openings, the printing apparatus comprising:

wiping means for wiping an ejection opening formed face of the print head in which the ejection openings are formed;

preliminary ejection means for ejecting ink not contributing to an image forming from the ejection openings of the print head; and modifying means for changing, according to event history information of the print head, the number of ink droplets to be ejected by the preliminary ejection means following a wiping operation of the wiping means, wherein the event history information or the print head is a cumulative printed dot number representing a cumulative number of ink droplets ejected from the print head and wherein the modifying means increases the number of ink droplets to be ejected by the preliminary ejection means as the cumulative printed dot number increases.

2. An ink jet printing apparatus according to claim 1, further comprising:

memory means for storing the event history information of the print head;

wherein the modifying means changes, according to the event history information stored in the memory means, the number of ink droplets to be ejected by the preliminary ejection means following the wiping operation of the wiping means.

3. An ink jet printing apparatus to form an image by using a print head capable of ejecting ink from its ejection openings, the printing apparatus comprising:

wiping means for wiping an ejection opening formed face of the print head in which the ejection openings are formed;

preliminary ejection means for electing ink not contributing to an image forming from the ejection openings of the print head; and modifying means for changing, according to event history information of the print head, the number of ink droplets to be ejected by the preliminary ejection means following a wiping operation of the wiping means, wherein the event history information of the print head is a cumulative time in which the print head is mounted in the ink jet printing apparatus and wherein the modifying means increases the number of ink droplets to be ejected by the preliminary ejection means as the cumulative print head mounting time increases.

4. An ink jet printing apparatus according to claim 3, further comprising:

memory means for storing the event history information of the print head;

wherein the modifying means changes, according to the event history information stored in the memory means, the number of ink droplets to be ejected by the preliminary ejection means following the wiping operation of the wiping means.

5. An ink jet printing apparatus to form an image by using a print head capable of ejecting ink from its ejection openings, the printing apparatus comprising:

wiping means for wiping an ejection opening formed face of the print head in which the ejection openings are formed;

preliminary ejection means for ejecting ink not contributing to an image forming from the ejection openings of the print head; and modifying means for changing, according to event history information of the print head, the number of ink droplets to be ejected by the preliminary ejection means following a wiping operation of the wiping means, wherein the event history information of the print head is a time which clapses from a wiping operation of the wiping means to a start of a printing operation on a printing medium and wherein the modifying means decreases the number of ink droplets to be ejected by the preliminary ejection means as the elapsed time increases.

6. An ink jet printing apparatus according to claim 5, further comprising:

memory means for storing the event history information of the print head;

wherein the modifying means changes, according to the event history information stored in the memory means, the number of ink droplets to be ejected by the preliminary ejection means following the wiping operation of the wiping means.

7. An ink jet printing apparatus to form an image by using a print head capable of ejecting ink from its ejection openings, the printing apparatus comprising:

wiping means for wiping an ejection opening formed face of the print head in which the ejection openings are formed;

preliminary ejection means for ejecting ink not contributing to an image forming from the ejection openings of the print head; and modifying means for changing, according to event history information of the print head, the number of ink droplets to be ejected by the preliminary ejection means following a wiping operation of the wiping means, wherein the event history information is information related to a degradation of repellency of the ejection opening formed face of the print head.

8. An ink jet printing apparatus according to claim 7, further comprising:

memory means for storing the event history information of the print head;

wherein the modifying means changes, according to the event history information stored in the memory means, the number of ink droplets to be ejected by the preliminary ejection means following the wiping operation of the wiping means.

9. A print head recovery method for performing a recovery operation to maintain an ink ejection performance of a print head in good condition, the print head being capable of ejecting ink from its ejection openings, the print head recovery method comprising the steps of:

using wiping means for wiping an ejection opening formed face of the print head in which the ejection openings are formed and preliminary ejection means for ejecting ink not contributing to an image forming from the ejection openings of the print head; and changing, according to event history information of the print head, the number of ink droplets to be ejected by the preliminary ejection means following a wiping operation of the wiping means, wherein the event history information of the print head is a cumulative printed dot number representing a cumulative number of ink droplets ejected from the print head and wherein the step of changing the number of ink droplets to be ejected comprises increasing the number of ink droplets to be ejected by the preliminary ejection means as the cumulative printed dot number increases.

10. A print head recovery method for performing a recovery operation to maintain an ink ejection performance of a print head in good condition, the print head being capable of ejecting ink from ejection openings, the print head recovery method comprising:

wiping an ejection opening formed face of the print head in which the ejection openings are formed;

ejecting ink not contributing to an image forming from the ejection openings of the print head; and changing, according to event history information of the print head, the number of ink droplets to be ejected following wiping, wherein the event history information of the print head is a cumulative time in which the print head is mounted in the ink jet printing apparatus and wherein the changing step increases the number of ink droplets to be ejected as the cumulative print head mounting time increases.

11. A print head recovery method for performing a recovery operation to maintain an ink ejection performance of a print head in good condition, the print head being capable of ejecting ink from ejection openings, the print head recovery method comprising:

wiping an ejection opening formed face of the print head in which the ejection openings are formed;

ejecting ink not contributing to art image forming from the ejection openings of the print head; and changing, according to event history information of the print head, the number of ink droplets to be ejected following wiping, wherein the event history information of the print head is a time which elapses from a wiping to a start of a printing operation on a printing medium and wherein the changing step decreases the number of ink droplets to be ejected as the elapsed time increases.

12. A print head recovery method for performing a recovery operation to maintain an ink ejection performance of a print head in good condition, the print head being capable of ejecting ink from ejection openings, the print head recovery method comprising:

wiping an ejection opening formed face of the print head in which the ejection openings are formed;

ejecting ink not contributing to an image forming from the ejection openings of the print head; and changing, according to event history information of the print head, the number of ink droplets to be ejected following wiping, wherein the event history information is information related to a degradation of repellency of the ejection opening formed face of the print head.

* * * * *

UNITED STATES PATENT AND TRADEMARK OFFICE

CERTIFICATE OF CORRECTION

PATENT NO. : 7,052,107 B2
APPLICATION NO. : 10/849954
DATED : May 30, 2006
INVENTOR(S) : Hiroshi Yamada et al.

It is certified that error appears in the above-identified patent and that said Letters Patent is hereby corrected as shown below:

Column 13

Line 3, replace “or” with “of”.

Line 25, replace “electing” with ejecting”.

Line 62, replace “clapses” with “elapses”.

Column 15

Line 17, replace “art” with “an”.

Signed and Sealed this

Twenty-second Day of August, 2006

JON W. DUDAS
*Director of the United States Patent and Trademark Office*